US011413199B2

(12) United States Patent
Olsommer et al.

(10) Patent No.: US 11,413,199 B2
(45) Date of Patent: Aug. 16, 2022

(54) ELECTRICAL ASSISTANCE DEVICE

(71) Applicants: COMPAGNIE GENERALE DES ETABLISSEMENTS MICHELIN, Clermont-Ferrand (FR); Electricite De France, Paris (FR)

(72) Inventors: David Olsommer, Clermont-Ferrand (FR); Thomas Pasutto, Moret-sur-Loing (FR); Alain Schmid, Plaisir (FR)

(73) Assignees: COMPAGNIE GENERALE DES ETABLISSEMENTS MICHELIN, Clermont-Ferrand (FR); ELECTRICITE DE FRANCE, Paris (FR)

( * ) Notice: Subject to any disclaimer, the term of this patent is extended or adjusted under 35 U.S.C. 154(b) by 0 days.

(21) Appl. No.: 17/429,129

(22) PCT Filed: Feb. 7, 2020

(86) PCT No.: PCT/FR2020/050218
§ 371 (c)(1),
(2) Date: Aug. 6, 2021

(87) PCT Pub. No.: WO2020/161447
PCT Pub. Date: Aug. 13, 2020

(65) Prior Publication Data

US 2022/0031537 A1 Feb. 3, 2022

(30) Foreign Application Priority Data

Feb. 7, 2019 (FR) ..... 1901231

(51) Int. Cl.
*A61G 5/04* (2013.01)
*A61G 5/02* (2006.01)

(52) U.S. Cl.
CPC ..... *A61G 5/048* (2016.11); *A61G 5/02* (2013.01)

(58) Field of Classification Search
CPC ..... A61G 5/048
See application file for complete search history.

(56) References Cited

U.S. PATENT DOCUMENTS 2,798,565 A 7/1957 Rosenthal et al.
3,112,001 A 11/1963 Wise
(Continued)

FOREIGN PATENT DOCUMENTS

FR 3088189 A3 5/2020
WO 2014/086727 A1 6/2014

OTHER PUBLICATIONS

International Search Report dated Mar. 20, 2020, in corresponding PCT/FR2020/050218 (4 pages).

*Primary Examiner* — Erez Gurari
(74) *Attorney, Agent, or Firm* — Venable LLP

(57) ABSTRACT

The present invention relates to an electrical assistance device (1) for a wheelchair (100) having a seat (103) and at least one rear wheel (104, 105) having a tyre (110), the electrical assistance device (1) comprising:

at least one motor (2) having a rotor (22) connected to a pinion (4) designed to mesh with a complementary toothset of the tyre (110), and a mobile arm (6) connecting said motor (2) to the wheelchair (100).

The mobile arm (6) allows said motor (2) to be manoeuvred between an engaged position in which the pinion (4) is in contact with the complementary toothset of said tyre (110), a disengaged position in which the pinion (4) is not in contact with the complementary toothset of said tyre (110)
(Continued)

and a transport position in which the pinion (4) is distanced from the tyre (110) and retracted beneath the seat (103).

9 Claims, 5 Drawing Sheets

(56) References Cited

U.S. PATENT DOCUMENTS

| | | | | |
|---|---|---|---|---|
| RE26,044 | E | 6/1966 | Wise | |
| 6,050,356 | A * | 4/2000 | Takeda | A61G 5/045 180/65.1 |
| 6,059,060 | A * | 5/2000 | Kanno | B60L 50/60 180/65.8 |
| 6,230,831 | B1 * | 5/2001 | Ogata | B60L 50/52 180/65.1 |
| 9,475,546 | B2 | 10/2016 | Olsommer et al. | |
| 9,533,734 | B2 | 1/2017 | Olsommer et al. | |
| 9,975,601 | B2 | 5/2018 | Olsommer | |
| 9,975,602 | B2 | 5/2018 | Olsommer | |
| 10,167,050 | B2 | 1/2019 | Olsommer | |
| 10,167,051 | B1 * | 1/2019 | Richter | A61G 5/02 |
| 2010/0200311 | A1 * | 8/2010 | Huang | A61G 5/045 180/6.24 |
| 2014/0262575 | A1 * | 9/2014 | Richter | A61G 5/128 180/167 |
| 2015/0336632 | A1 | 11/2015 | Olsommer et al. | |
| 2016/0242977 | A1 * | 8/2016 | Richter | A61G 5/047 |
| 2018/0280213 | A1 * | 10/2018 | Hancock | A61G 5/08 |

* cited by examiner

[Fig. 1]
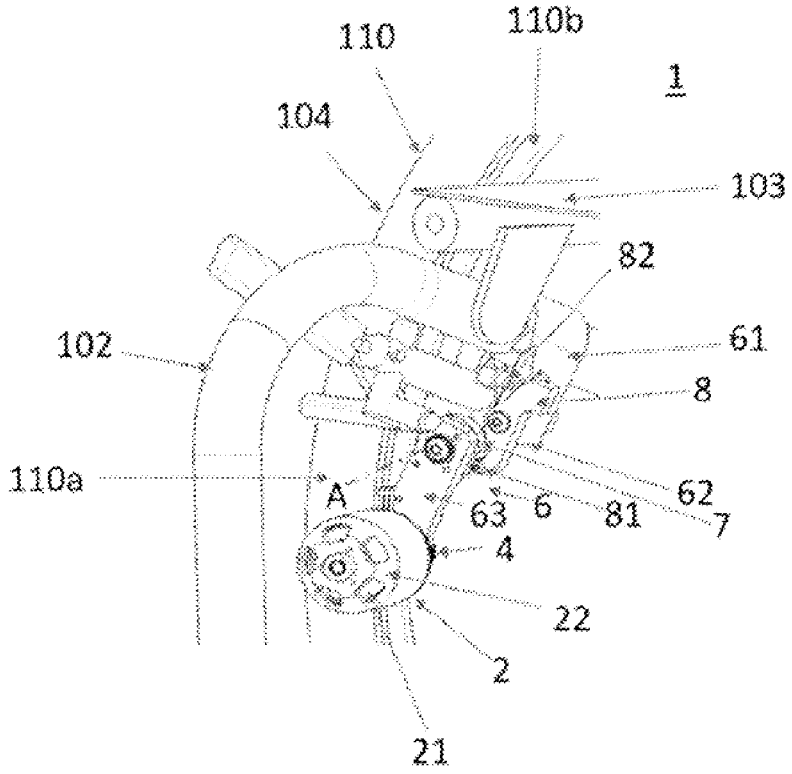
[Fig. 2]
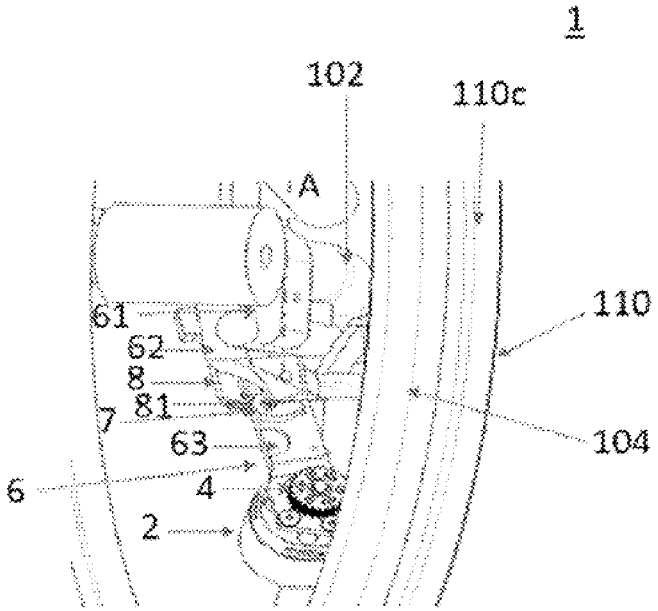

[Fig. 3]
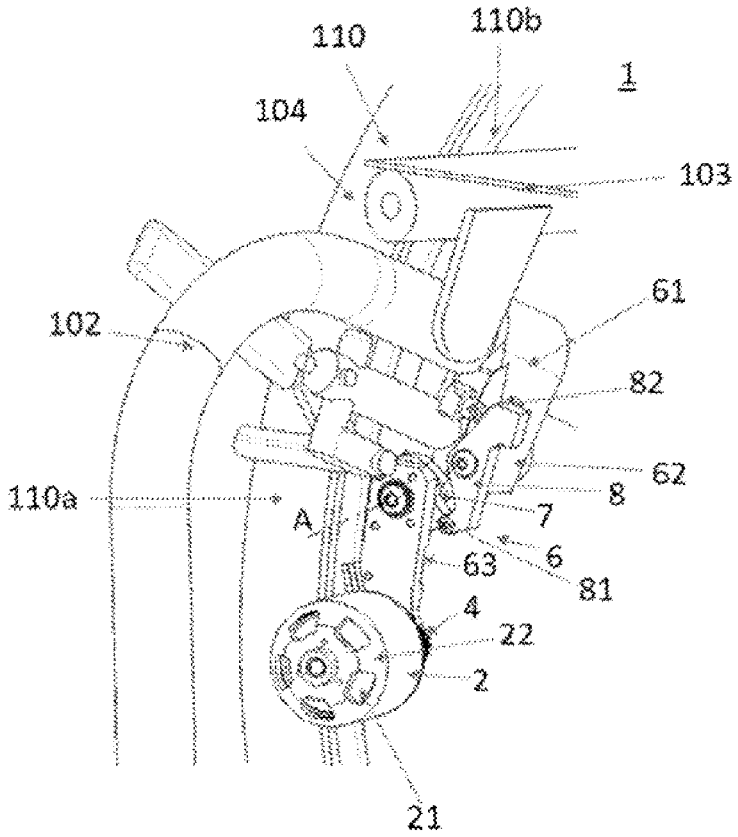
[Fig. 4]
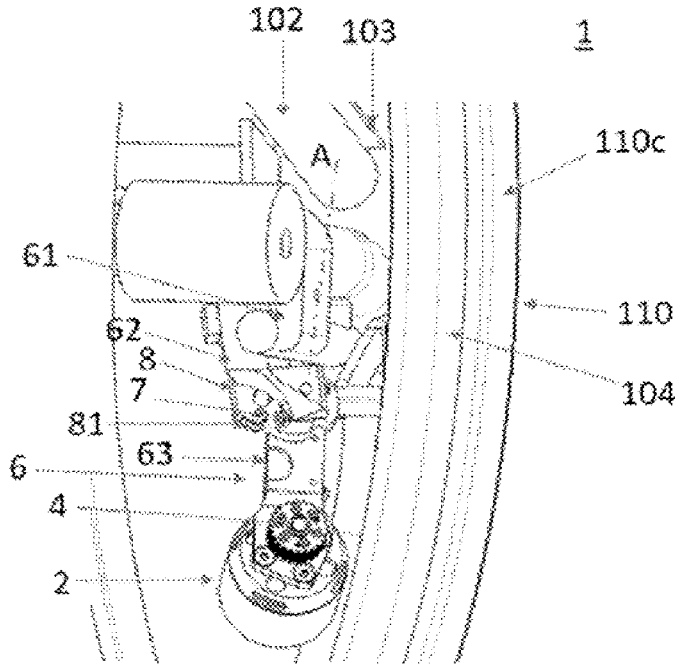

[Fig. 5]
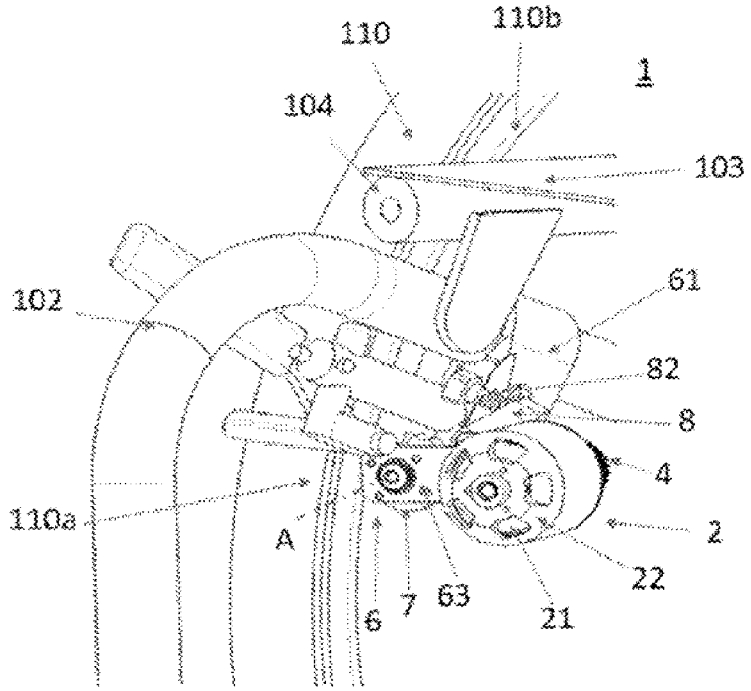
[Fig. 6]
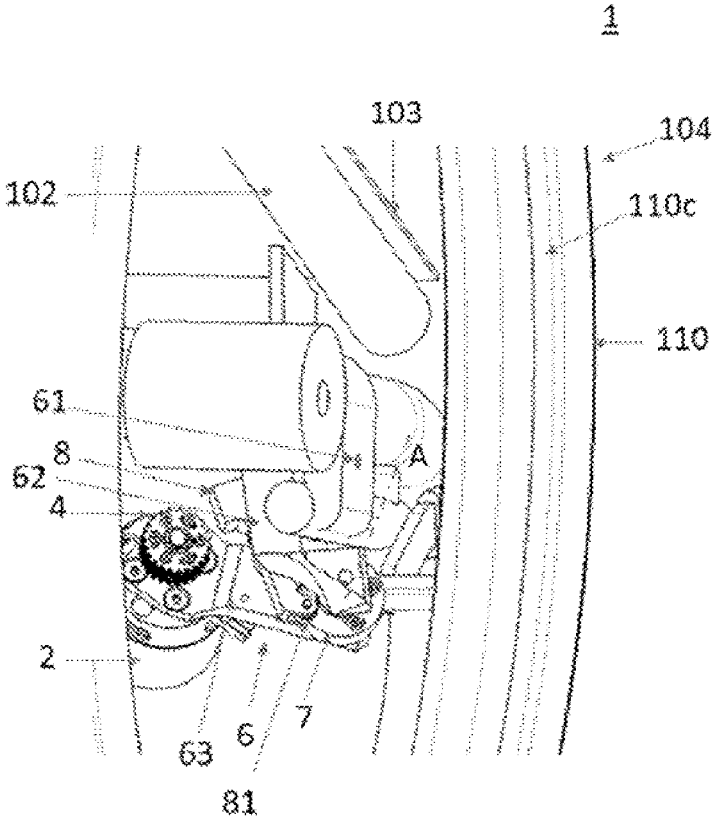

[Fig. 7]
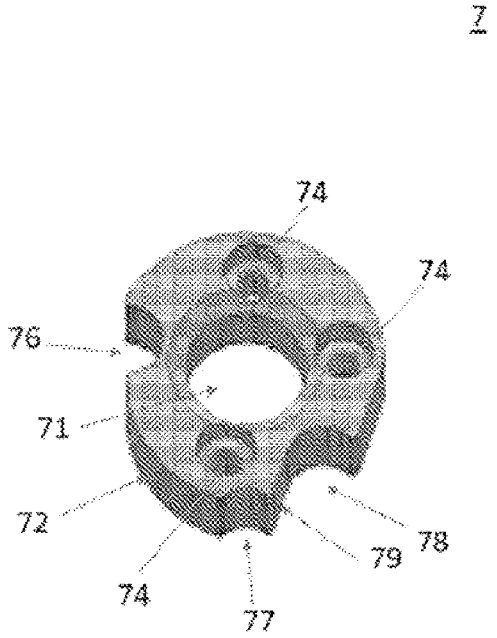
[Fig. 8]
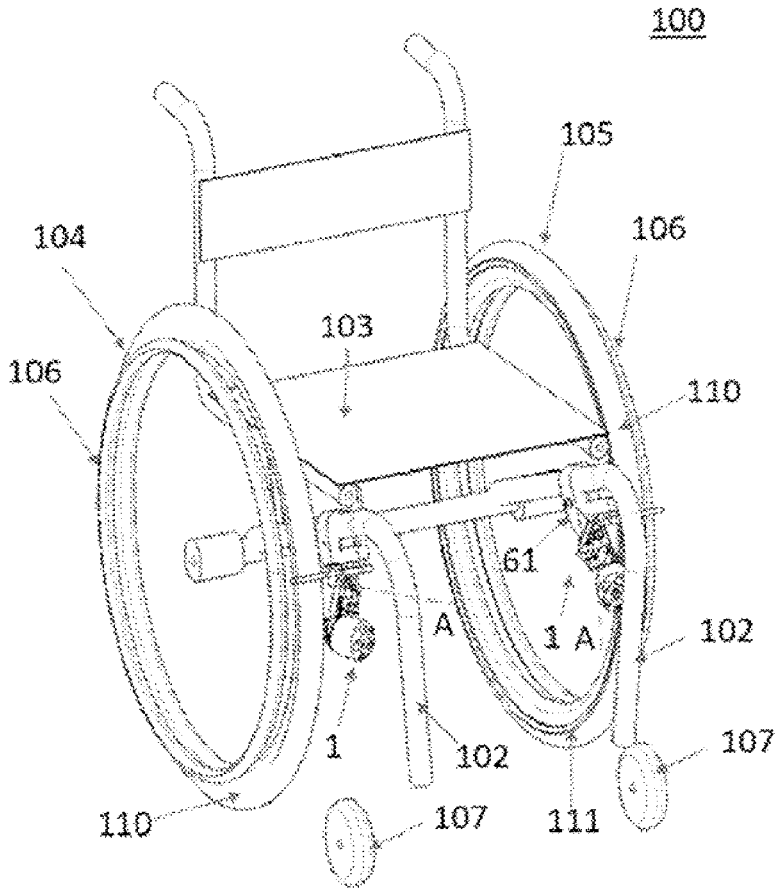

[Fig. 9]
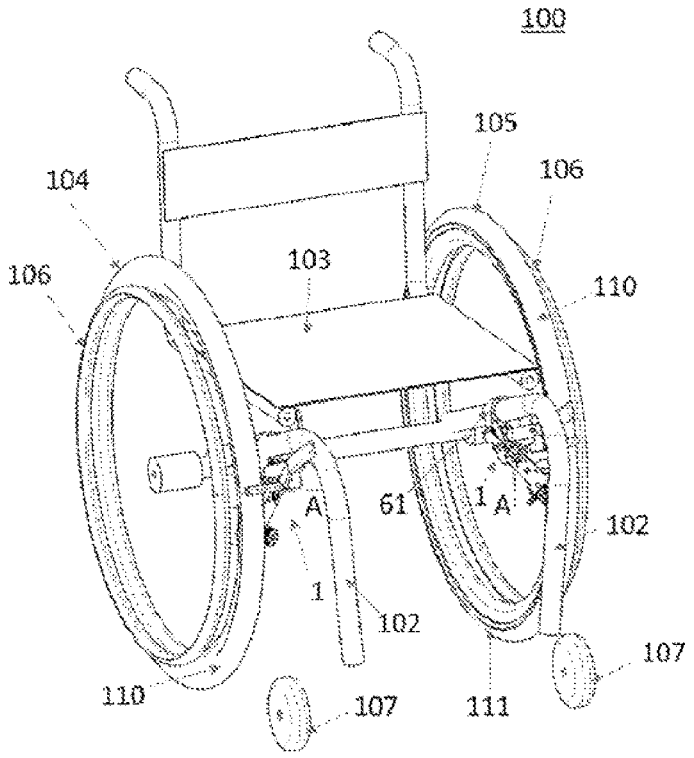
[Fig. 10]
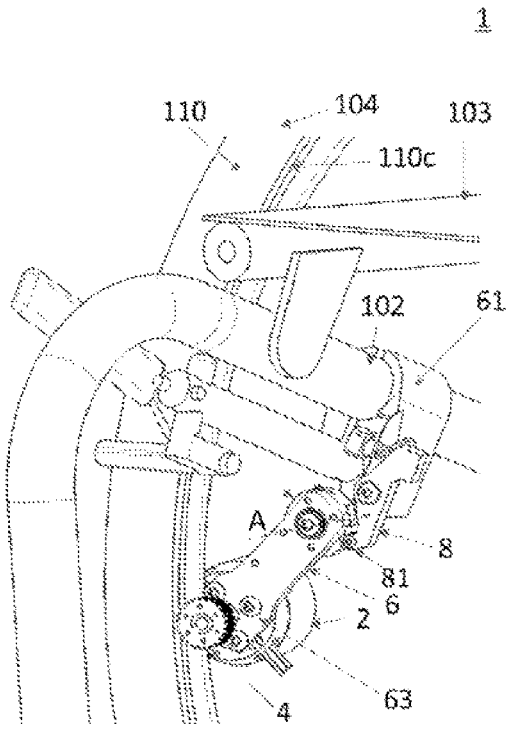

ELECTRICAL ASSISTANCE DEVICE

FIELD OF THE INVENTION

The present invention relates to the field of mobility for individuals living with a disability, and relates more particularly to an electrical assistance device for a wheelchair.

PRIOR ART

In general, there are two known types of wheelchair.

On the one hand, fully manual wheelchairs, which conventionally have two large rear wheels and two small front wheels. The front wheels are able to rotate about a transverse axis and the rear wheels are prevented from rotating about this same transverse axis.

An annular hand rim is usually provided on the side of each rear wheel. The wheelchair is propelled and steered either by the user, using the annular hand rims to turn the rear wheels, or by a third party pushing the wheelchair.

A second type of known wheelchair is the motorized wheelchair.

These wheelchairs are often far bulkier and heavier than the manual wheelchairs. These wheelchairs traditionally comprise four or six wheels, smaller in diameter in comparison with the rear wheels of a manual wheelchair. Furthermore, the wheelchair incorporates electric motors, large batteries, and a steering system. This is because known motorized wheelchairs can be controlled only using a steering system. This is usually of the "joystick" type. This arrangement makes the wheelchair particularly useful for individuals with multiple disabilities, but prevents any manual manoeuvring.

Furthermore, as the wheelchair is able to move only under the propulsion of the motors, it is necessary to have batteries of large capacity, which adds enormously to the weight of the wheelchair.

A third type of wheelchair, which is not as commonplace, is a manual wheelchair converted into an electric wheelchair.

Thus, for example, manual wheelchairs are known in which a motor is incorporated into the hub of each rear wheel. The motor is an electrical assistance motor. That means that the motors are not sufficient in themselves to move the wheelchair but provide a force top-up, so that less effort is demanded of the user.

The wheelchair is still controlled using the annular hand rims. This solution is particularly advantageous because it provides the user with assistance when climbing a slope, for example, or to avoid fatigue over long distances.

Nevertheless, this solution can be used only on a wheelchair specifically adapted for that. In other words, this solution cannot be adapted to any non-specific manual wheelchair.

Another solution for motorizing a manual wheelchair is to add to the wheelchair a device that has a motorized wheel. This device usually takes the form of a front wheel, with a handlebar. The device is therefore fixed at the front of the wheelchair. The handlebar works like a motorbike handlebar with one rotary handgrip to control the speed of the motor, and another handgrip for braking. This device is not an assistance system but rather an actual full motorization system. Thus, the user no longer uses their arms to propel and steer the wheelchair. In the event of a breakdown, just as in a standard motorized wheelchair, it is impossible for the user to move the wheelchair.

Utility Certificate application FR1860425 filed by one of the applicants addresses these deficiencies by providing a novel electrical assistance solution that can be adapted universally to suit a large number of wheelchairs, and which does not have the disadvantages of the prior art.

This application describes an electrical assistance device for a wheelchair which comprises at least one motor having a rotor connected to a pinion designed to mesh with a complementary toothset of a tyre of a wheel of the wheelchair.

SUMMARY OF THE INVENTION

It is an objective of the present invention to improve an electrical assistance device for a wheelchair.

To this end, according to a first aspect, the invention proposes an electrical assistance device for a wheelchair having a seat, and at least one rear wheel having a tyre. The electrical assistance device comprises:

- at least one motor having a rotor connected to a pinion designed to mesh with a complementary toothset of the tyre, and
- a mobile arm connecting said motor to the wheelchair.

The mobile arm allows said motor to be manoeuvred between an engaged position in which the pinion is in contact with the complementary toothset of said tyre, a disengaged position in which the pinion is not in contact with the complementary toothset of said tyre, and a transport position in which the pinion is distanced from the tyre and retracted beneath the seat.

The mobile arm able to move between three positions (engaged, disengaged, and transport position) both allows the device to be engaged/disengaged at will, and allows the device to be placed in a retracted position, beneath the seat, particularly suitable for transport. Specifically, in the transport position, there is less risk of the device being damaged, for example when the wheelchair is in the luggage compartment of a vehicle.

Thus, the mobile arm allows the device to be protected.

The arm may comprise a cam allowing the electrical assistance device to be positioned and held in the engaged position, in the disengaged position, or in the transport position.

The cam may have at least three cutouts and a substantially planar surface, all of which are designed to collaborate with a cam-follower belonging to a mobile lever, so as to hold the electrical assistance device in the engaged position, in the disengaged position, or in the transport position.

The mobile lever capable of rotating with respect to the arm may comprise the cam-follower designed to be engaged in a cutout or on the substantially planar surface of the cam so as to hold the electrical assistance device in the engaged position, in the disengaged position, or in the transport position.

The lever may comprise, at one end, the cam-follower that maintains pressure against the cam through the agency of a return spring.

The arm may comprise a distal part intended to be connected to the wheelchair, and a proximal part connected to the motor. The distal part and the proximal part being able to be articulated to one another by an articulation concentric with the cam.

According to another aspect, the invention proposes a wheelchair comprising a seat and two rear wheels each having a tyre. The wheelchair comprises at least one electrical assistance device according to the invention.

The wheelchair may comprise a chassis made up of a plurality of tubes, a seat, and two rear wheels, and two electrical assistance devices, positioned on the underside of the seat, each connected to a tube and each designed to mesh with a tyre of a corresponding rear wheel.

The wheelchair may comprise an electrical assistance device wherein the distal part of the arm of each electrical assistance device is connected to a tube.

DESCRIPTION OF THE FIGURES

Further features, objects and advantages of the invention will become apparent from the following description, which is purely illustrative and non-limiting and which should be read in conjunction with the appended drawings, in which:

FIG. 1 is a partial depiction, in perspective, of a wheelchair equipped with an electrical assistance device according to the invention, in the engaged position.

FIG. 2 is a partial depiction, in perspective, of a wheelchair equipped with an electrical assistance device according to the invention, in the engaged position, from a different viewpoint.

FIG. 3 is a partial depiction, in perspective, of a wheelchair equipped with an electrical assistance device according to the invention, in the disengaged position.

FIG. 4 is a partial depiction, in perspective, of a wheelchair equipped with an electrical assistance device according to the invention, in the disengaged position, from a different viewpoint.

FIG. 5 is a partial depiction, in perspective, of a wheelchair equipped with an electrical assistance device according to the invention, in the transport position.

FIG. 6 is a partial depiction, in perspective, of a wheelchair equipped with an electrical assistance device according to the invention, in the transport position, from a different viewpoint.

FIG. 7 is a detailed depiction, in perspective, of a cam of an electrical assistance device according to the invention.

FIG. 8 is a schematic partial depiction, in perspective, of a wheelchair equipped with two electrical assistance devices according to the invention.

FIG. 9 is a schematic partial depiction, in perspective, of a wheelchair equipped with two electrical assistance devices according to another embodiment of the invention.

FIG. 10 is a partial depiction, in perspective, of a wheelchair equipped with an electrical assistance device according to another embodiment of the invention, in the engaged position.

Across all the figures, the elements that are similar bear identical references.

DETAILED DESCRIPTION OF THE INVENTION

Electrical Assistance Device

According to a first aspect, the invention relates to an electrical assistance device 1 for a wheelchair 100 depicted in FIGS. 8 and 9.

The electrical assistance device 1 essentially comprises a motor 2, a pinion 4 and an arm 6.

More particularly, as can be seen in FIGS. 1 to 6 and 10, the electrical assistance device 1 comprises a motor 2, preferably an electric motor. The motor 2 has a rotor 22 and a stator 21. According to the embodiment set out here, this is a motor 2 of the external rotor 22 motor 2 type. Alternatively, it could be a more conventional internal rotor 22 motor 2.

The rotor 22 is connected to the pinion 4. The rotor 22 is mounted on the stator 21 using ball bearings. The pinion 4 is driven directly by the rotor 22. In a variant, it may be driven by the rotor 22 through the agency of a freewheel.

The pinion 4 is intended to collaborate with a tyre 110 of a wheel 104, 105 of the wheelchair 100, i.e. is intended to come into contact with a tread 110*a* or, preferably, a sidewall 110*b* of this tyre 110, so as to be able to transmit thereto a force that is able to rotate the tyre 110 and propel the wheelchair 100.

The pinion 4 is a toothed wheel, i.e. is not plain and has a toothset, in other words a plurality of projecting elements improving contact and friction between the pinion 4 and the tyre 110. As will be seen, the tyre 110 is judiciously also toothed in a complementary manner, i.e. so as to be able to mesh with the toothset of the pinion 4. It will therefore be appreciated that the force is transmitted far more effectively directly by the pressure of the toothsets, rather than simply by friction. Thus, as a preference, at least one of the sidewalls 110*b*, 110*c* of the tyre 110 (preferably a sidewall referred to as "inboard" 110*b*, because the wheel 104, 105 is often equipped with an annular hand rim 106 on the side of the other sidewall referred to as the outboard sidewall 110*c*, see later) exhibits the toothset (not depicted), which means that the tread 110*a* is able to retain a tread pattern that encourages good grip between the tyre 110 and the ground.

Alternatively, use could be made of straight-cut, helical or else double-helical (herringbone) toothsets.

It is emphasized that, in the case of a helical or double-helical toothset, at least one of the sidewalls of each tyre 110, notably the inboard sidewall 110*b*, may have a toothset. Thus, each tyre 110 has a toothset on at least one side and can be used indifferently as a right-hand wheel 104 or a left-hand wheel 105 of the wheelchair 100, without being constrained by the particular geometry of the toothset when this toothset has a symmetrical profile. In the first embodiment illustrated in FIGS. 1 to 4, use is made of identical tyres 110 each having a helical toothset with a symmetrical profile on an inboard sidewall 110*b*, which toothset collaborates with identical pinions 4 (which means to say pinions having identical toothsets) arranged one on the side of the right-hand rear wheel 104 and the other of the left-hand rear wheel 105 of the wheelchair 100.

Whatever the embodiment chosen (straight-cut, helical or double-helical toothset), it will be preferable to employ a toothset that is symmetrical. What is meant by a symmetrical toothset is a toothset that allows meshing and the transmission of a force whatever the direction of rotation of the pinion 4 (as opposed to an asymmetric toothset in which just one direction of rotation of the pinion 4 would allow the transmission of force).

Advantageously, the toothset has a pitch comprised between 1 and 4 millimetres. Particularly advantageously, the toothset has a pitch of around 3 millimetres, allowing optimal transmissible torque for a low level of noise.

The pinion 4 is preferably made of metal, for example of steel as a stack of stamped-out laminations each between 0.5 and 2 mm thick, or by milling.

The toothset of the sidewall 110*b*, 110*c* of the tyre is preferably made up of a rubber compound with a Shore A hardness preferably comprised between 55 and 95 and more preferably still between 75 and 95 to promote the magnitude of the motive force that can be transmitted by the motor. The toothset is moulded at the same time as the tyre 110 or else may be added on to a previously moulded tyre 110.

The motor 2 is connected to the wheelchair by the mobile arm 6.

As will be detailed, according to the embodiment set out here, the mobile arm 6 allows the motor to be manoeuvred between three positions: an engaged position (FIGS. 1 and 2) in which the toothset of the pinion 4 is in contact (i.e. in mesh) with the toothset of the tyre 110 (electrical assistance is therefore possible); a disengaged position (FIGS. 3 and 4) in which the pinion 4 is not in contact with the tyre 110 (i.e. not in mesh with the toothset of the tyre 110, in other words—slightly—distanced from the tyre 110) (the wheelchair 100 reverts to manual mode); and a transport position (FIGS. 5 and 6) in which the pinion 4 is distanced from the tyre 110 and retracted beneath the seat 103. In other words, the arm 6 allows the pinion 4 to be moved towards or away from the tyre 110.

It is notable that, in the disengaged position, the motor 2 remains near the wheel 104 or 105, and especially that in the disengaged position the pinion 4 is not retracted beneath the seat 103. Furthermore, as can be seen in FIGS. 3 and 4, a proximal portion 63 of the arm 6, which portion is fixed to the motor 2, is oriented on an axis substantially parallel to a plane of the rear wheel 104 or 105. This arrangement allows a user to be able easily to position the electrical assistance device 1 in the engaged position, if desired. By contrast, in the transport position, the motor is retracted beneath the seat 103, a distance away from the wheel 104 or 105 (i.e. in the transport position, the motor 2 is further away from the wheel 104 or 105 than in the disengaged position). Furthermore, as can be seen in FIGS. 5 and 6, in the transport position, the proximal portion 61 of the arm 6 is oriented on an axis substantially perpendicular to the plane of the rear wheel 104 or 105.

The presence of distinct positions for disengagement and for transport is particularly advantageous. Specifically, the disengaged position is particularly practical when running, as the proximity of the motor 2 to the wheel 104 or 105 allows the electrical assistance device 1 to be engaged quickly. By contrast, the disengaged position does not allow the wheelchair 100 to be folded, or at the very least does not allow the wheelchair 100 to be folded in a compact manner as the system part 1 forms a protrusion that is somewhat impractical for transport. The transport position, on the other hand, allows the wheelchair 100 to be folded without the system 1 protruding. Thus, these two positions (the disengaged position and the transport position) complement each other and have different effects.

The arm 6 comprises a clamp 61 designed to clamp onto a tube 102 of the wheelchair 100.

The clamp 61 has two half-jaws. The two half-jaws are screwed together. This assembly allows the device 1 to be fixed as desired to a wheelchair 100, while at the same time affording maximum safety. Specifically, when the two half-jaws are screwed together they reliably hold the device 1 in place.

Furthermore, according to the embodiment set out here, the arm 6 comprises a distal part 62 and a proximal part 63 which are articulated to one another.

The distal part 62 comprises the jaw 61 and the proximal part 63 is connected to the motor 2.

An articulation connects the distal part 62 and the proximal part 63. The articulation is a pivot connection of axis A. The articulation is provided with a cam 7.

With reference to FIG. 7, the cam 7 has a central bore 71 and a substantially oblong exterior envelope 72 and three interior bores 74. Three cutouts 76, 77 and 78 are made in the exterior envelope 72. A substantially planar surface 79 on the exterior envelope 72 acts as a working surface in the engaged-position mode. As will be described later on, the cutouts 76 and 77 allow the proximal part 63 to be locked in terms of rotation with respect to the distal part 62 for the transport and disengaged modes respectively. The substantially planar surface 79 itself serves to maintain substantially constant pressure between the pinion 4 and the toothset of the inboard sidewall of the tyre, this being in order to accommodate any potential out-of-true of the wheels and other imperfections in the relative positionings of the tyre and drive system. The cutout 78 acts as an end stop if the wheelchair wheel is removed while the system is in the engaged position, to limit the rotation of the arm 63.

The central bore 71 allows the distal part 62 and the proximal part 63 to be connected so as to pivot. The three interior bores 74 allow the cam 7 to be fixed to the proximal part 63 in a built-in manner. Thus, the cam 7 is able to rotate with respect to the distal part 62 but is firmly attached in terms of rotation to the proximal part 63. In other words, rotation of the cam 7 causes the proximal part 63 to rotate with respect to the distal part 62 which is fixed and connected to the chassis of the wheelchair 100.

Furthermore, the electrical assistance device 1 comprises a lever 8 able to rotate about axis A with respect to the distal part 62. The lever 8 has one end fitted with a cam-follower 81. The cam-follower 81 is configured to engage in the cutouts 76, 77 and 78, and to press against the substantially planar surface 79.

A return spring 82 tends to maintain a force of contact between the cam-follower 81 and the cam 7. When the cam-follower is in the cutouts 76, 77 or 78 (the cam-follower 81 can enter the cutout 78 only when the wheel is removed from the wheelchair), these are stable positions in which the proximal part 63 is fixed in terms of rotation with respect to the distal part. When the cam-follower is on the substantially planar surface 79, the force of contact of the cam-follower 81 with this substantially planar surface has the effect of applying a rotational torque to the proximal part of the arm 63, this having the effect of causing pressure between the pinion 4 and the sidewall of the tyre. This rotational torque is caused by the fact that the substantially planar surface 79 is not normal to a radius originating at the centre of rotation of the cam 7.

The transition from one position to another may be brought about by manoeuvring only the motor 2 or the proximal part 63. Under the force applied, the cam-follower 81 exits the cutout 76, 77 or 78 or else the substantially planar surface 79 and slides over the exterior envelope 72.

In addition, the electrical assistance device 1 comprises in a known way a potentiometer (not depicted) or some other means of regulating the electrical power supplied to the motor 2 and therefore of adjusting the rotational speed thereof.

According to one particularly advantageous arrangement, one single potentiometer is able to control several motors 2.

Advantageously, the electrical assistance device 1 also comprises one or more electric batteries able to power the motor or motors 2.

A person skilled in the art will be able to use known control algorithms for controlling the motor or motors 2 in order to provide optimal electrical assistance.

Wheelchair

According to a second aspect, the invention relates to a wheelchair 100 equipped with one or more electrical assistance devices 1.

In a conventional way, the wheelchair 100 is a known manual wheelchair comprising a chassis made up of a plurality of tubes 102, a seat 103, two rear wheels 104, 105 and two front wheels 107. Traditionally, the two rear wheels 104, 105 have a diameter markedly greater than the diameter of the two front wheels 107. The two rear wheels 104, 105 are each equipped with an annular hand rim 106. The annular hand rims 106 allow a user to propel and steer the wheelchair 100.

In a particularly advantageous manner, each rear wheel 104, 105 is fitted with a tyre 110. Each tyre 110 has a tread 110*a* intended to come into contact with the ground, two sidewalls 110*b* and 110*c*, one of them an inboard sidewall 110*b* (oriented toward the middle of the wheelchair 100) and one an outboard sidewall 110*c* (oriented toward the outside of the wheelchair 100 and on the side on which the annular hand rim 106 is found).

The wheelchair 100 is equipped with at least one electrical assistance device 1 designed to collaborate with at least one wheel 104, 105, particularly the right-hand rear wheel 104 or left-hand rear wheel 105 (because these are the largest wheels that bear most of the weight of the user thereof and are therefore capable of transmitting a high traction force to the ground without a loss of grip between the tyre and the ground). Through improper use of language, it may be said that at least one wheel 104, 105 of the wheelchair is equipped with the device 1.

As a preference, the wheelchair 100 is equipped with at least two electrical assistance devices 1, i.e. at least one for each rear wheel 104 and 105, particularly one with the left-hand rear wheel 105 and one with the right-hand rear wheel 104. Such an embodiment allows more efficient symmetrical propulsion and if necessary even allows the wheelchair 100 to be turned by applying different rotational speeds or torques on the left and on the right. It will be appreciated that it is still possible to fit several devices 1 to just one wheel, so as to step down the power.

As explained, said tyre 110 of a wheel 104, 105 fitted with the device 1 has a toothset that complements a toothset of the pinion 4 connected to the rotor 22 of said motor 2 of the electrical assistance device 1.

Advantageously, at least one of the sidewalls 110*b*, 110*c*, and particularly the inboard sidewall 110*b*, and preferably each of the sidewalls 110*b*, 110*c*, has a symmetrical helical toothset that complements the symmetrical helical toothset of the pinion 4. Advantageously, the toothset of the sidewall 110*b* has a pitch comprised between 1 and 4 millimetres. Particularly advantageously, the toothset of the sidewall 110*b* has a pitch of around 3 millimetres, allowing optimal transmissible torque for a low level of noise. The use of a symmetrical toothset, whether this is a straight-cut or a helical toothset, allows the same type of tyre 110 to be used indiscriminately for the right-hand rear wheel 104 or the left-hand rear wheel 105, i.e. it is possible to envision a configuration in which each of the rear wheels 104 is fitted with a device 1, while using the same tyre 110 (having the symmetrical toothset on each of its sidewalls 110*b*, 110*c*).

In another embodiment, use is made of an asymmetric toothset (for example of the type as described in patent application WO2014086727 in the name of the applicant company), allowing the transmissible torque to be increased still further. However, the use of such an asymmetric toothset entails having a specific left-hand tyre and a specific right-hand tyre, or else tyres that are identical from left to right but which have a toothset on both sidewalls, thus slightly increasing the cost of manufacture.

As a preference, each motor 2 is fixed by an arm 6 near each rear wheel 104, 105. So that the pinion 4 connected to each motor 2 can be meshed with the toothset of the tyre 110 of the corresponding rear wheel 104, 105.

According to a first embodiment depicted notably in FIGS. 1 and 8, the device 1 is oriented in such a way that the motor 2 is towards the front wheels 107. In other words, according to this embodiment, when considering the device 1 in a direction starting at the front wheels 107 and progressing towards the rear wheels 104, 105, the motor 2 is encountered first, followed by the pinion 4.

Conversely, according to a second embodiment depicted in FIGS. 9 and 10, the device 1 is oriented in such a way that the pinion 4 is towards the front wheels 107. In other words, according to this embodiment, when considering the device 1 in a direction starting at the front wheels 107 and progressing towards the rear wheels 104, 105, the pinion 4 is encountered first, followed by the motor 2. This second embodiment may prove more ergonomic for a user and may make it possible to avoid potential collisions between the motor 2 and objects at the front of the wheelchair, such as table legs for example. In addition, this second embodiment makes the system more discreet, by hiding the motors behind the wheels, something which users find advantageous.

During running, the arms 6 allow the pinions 4 to be manoeuvred between an engaged position in which the pinions 4 are each in mesh with a toothset of the corresponding tyre 110, and a disengaged position in which the pinions 4 are distanced from the tyres 110.

In other words, in the engaged position, the pinions 4 are in mesh with the tyres and the motors 2 are able to apply torque to the rear wheels 104, 105. In the disengaged position, the pinions are a distance away from the tyres and the motors 2 are unable to apply any torque to the rear wheels 104, 105.

In addition, the arms also allow the electrical assistance devices 1 to be manoeuvred into the transport position. In this position, the pinions 4 are distanced from the tyres 110 and are retracted beneath the seat 103. This arrangement is particularly useful when the wheelchair is placed for example in the luggage compartment of a vehicle. This transport position is also useful when the user is seated, unaccompanied, at the wheel of a motor vehicle, so as to allow the frame of the wheelchair to pass laterally between the user's knees and the steering wheel, as far as the passenger seat, and vice versa, so that the user can get back out of the vehicle and into their wheelchair by themselves. By being retracted beneath the seat 103, the electrical assistance devices 1 are less exposed to potentially becoming caught or knocked, which actions could damage them. In addition, this arrangement is particularly advantageous in the case of a folding wheelchair 100.

According to one particular arrangement, one single potentiometer may allow control of the rotational speed or torque of both motors 2.

In use, a user can operate the electrical assistance by positioning the arms 6 in the engaged position. The motors 2 may then apply torque to the rear wheels 104, 105. The force transmitted by the motors 2 will relieve the user who will have to supply less effort in order to propel the wheelchair using arm power. It must be specified that the electrical assistance is not able, on its own, to propel the wheelchair 100. The potentiometer allows adjustment of the power of the electrical assistance supplied. The user may, at any moment, place the arms 6 in the disengaged or transport position, thus disconnecting the electrical assistance.

In the disengaged, or transport, position, the user propels the wheelchair 100 by arm power alone.

Thus, the invention proposes an electrical assistance device that can be fitted to a manual wheelchair 100, allowing the wheelchair 100 to be used without electrical assistance, and allowing the assistance devices to be retracted to make the wheelchair 100 easier to transport.

The invention claimed is:

1. An electrical assistance device for a wheelchair having a seat and at least one rear wheel having a tire, the electrical assistance device comprising:

at least one motor having a rotor connected to a pinion designed to mesh with a complementary toothset of the tire, and a mobile arm connecting said motor to the wheelchair, wherein the mobile arm allows said motor to be maneuvered between an engaged position in which the pinion is in contact with the complementary toothset of said tire, a disengaged position in which the pinion is not in contact with the complementary toothset of said tire and a transport position in which the pinion is distanced from the tire and retracted beneath the seat.

2. The electrical assistance device according to claim 1, wherein the arm comprises a cam allowing the electrical assistance device to be positioned and held in the engaged position, in the disengaged position or in the transport position.

3. The electrical assistance device according to claim 2, wherein the cam has at least three cutouts and a substantially planar surface, all of which are designed to collaborate with a cam-follower belonging to a mobile lever, so as to hold the electrical assistance device in the engaged position, in the disengaged position, or in the transport position.

4. The electrical assistance device according to claim 3, wherein the mobile lever capable of rotating with respect to the arm comprises the cam-follower designed to be engaged in a cutout or on the substantially planar surface of the cam so as to hold the electrical assistance device in the engaged position, in the disengaged position, or in the transport position.

5. The electrical assistance device according to claim 4, wherein the lever comprises, at one end, the cam-follower that maintains pressure against a cam through the agency of a return spring.

6. The electrical assistance device according to claim 1, wherein the arm comprises a distal part intended to be connected to the wheelchair, and a proximal part connected to the motor, the distal part and the proximal part being articulated to one another by an articulation concentric with the cam.

7. A wheelchair comprising a seat and two rear wheels, each having a tire, wherein the wheelchair further comprises at least one electrical assistance device according to claim 1.

8. The wheelchair according to claim 7, further comprising a chassis made up of a plurality of tubes, a seat, and two rear wheels, wherein the wheelchair comprises two electrical assistance devices, positioned on the underside of the seat, each connected to a tube and each designed to mesh with a tire of a corresponding rear wheel.

9. The wheelchair according to claim 8, wherein the arm comprises a distal part intended to be connected to the wheelchair, and a proximal part connected to the motor, the distal part and the proximal part being articulated to one another by an articulation concentric with the cam, and wherein the distal part of the arm of each electrical assistance device is connected to a tube.

* * * * *